US006109364A

United States Patent [19]

Demuth et al.

[11] Patent Number: 6,109,364

[45] **Date of Patent: *Aug. 29, 2000**

[54] ROTARY HAMMER

[75] Inventors: Ulrich Demuth, Erbach-Ernsbach; Winrich Habedank, Diez, both of Germany

[73] Assignee: Black & Decker Inc., Newark, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/754,603

[22] Filed: Nov. 20, 1996

[30] Foreign Application Priority Data

Nov. 24, 1995 [DE] Germany ..... 195 45 260

[51] Int. Cl.[7] ..... E02D 7/02

[52] U.S. Cl. ..... 173/48

[58] Field of Search ..... 173/48, 201, 104, 173/114, 128, 200

[56] References Cited

U.S. PATENT DOCUMENTS

| | | | |
|---|---|---|---|
| 3,774,699 | 11/1973 | Schmuck | 173/48 |
| 3,791,461 | 2/1974 | Rosselet | 173/48 |
| 3,837,409 | 9/1974 | Consoli et al. | 173/48 |
| 3,847,229 | 11/1974 | Wanner et al. | 173/48 |
| 3,867,988 | 2/1975 | Koehler | 173/48 |
| 3,955,628 | 5/1976 | Grözinger et al. | 173/48 |
| 4,418,766 | 12/1983 | Grossman | 173/48 |
| 4,428,438 | 1/1984 | Holzer | 173/48 |
| 4,506,743 | 3/1985 | Grossman | 173/48 |
| 4,895,212 | 1/1990 | Wache | 173/48 |
| 5,036,925 | 8/1991 | Wache | 173/104 |
| 5,111,889 | 5/1992 | Neumaier | 173/48 |
| 5,435,397 | 7/1995 | Demuth | 173/201 |
| 5,456,324 | 10/1995 | Takagi et al. | 173/48 |

*Primary Examiner*—Valencia Martin-Wallace
*Assistant Examiner*—John Paradiso
*Attorney, Agent, or Firm*—Charles E. Yocum; John D. Del Ponti; Bruce S. Shapiro

[57] ABSTRACT

A rotary hammer with a tool holder and a hammer mechanism for the transmission of impact energy onto the drilling and/or chiselling bit in the tool holder has a switching device which with a single actuator makes it possible to switch between pure drilling operation, rotary hammering operation and pure hammering operation. The switching device acts on a coupling with which the hammer mechanism is couplable with a rotatingly driven intermediate shaft, and has a slide part for shifting a toothed wheel between a first position for the rotary driving of the tool holder and a second position in which no rotary driving of the tool holder takes place. The coupling for the hammer mechanism can be separated by a cam part coupled in untwistable manner with the actuator. The actuator extends through an opening of the recess in the slide part and has a cam section which, in one position, keeps the slide part in the second position, while, in the other positions of the actuator, the slide part is located in the first position. The cam part is provided at the section of the actuator projecting inwardly over the slide part.

7 Claims, 5 Drawing Sheets

ROTARY HAMMER

BACKGROUND OF THE INVENTION

The invention relates to a rotary hammer with a tool holder provided at the front end for a drilling and/or chiselling bit which is drivable by a rotary drive to produce a rotary movement of the drilling and/or chiselling bit, with a hammer mechanism for transmitting impact energy onto the drilling and/or chiselling bit, which hammer mechanism is couplable via a coupling to a rotatingly driven intermediate shaft, and with a switching device for switching between pure drilling operation, rotary hammering operation and pure hammering operation, which switching device has a single actuator to be operated by the user for switching between drilling, rotary hammering and hammering operation as well as a cam part which is untwistable relative to the actuator and a slide part for the axial shifting of a toothed wheel, which are coupled to the actuator, wherein, in the position for pure drilling, the cam part keeps the coupling disengaged and wherein, in a first position, the slide part keeps the toothed wheel in the position for the rotary driving of the tool holder and, in a second position, keeps it in the position in which no rotary driving of the tool holder takes place.

With a known rotary hammer of this type (EP 0 454 348 B1) there is attached to the actuator on one side a cam part which has an arcuate cam surface which lies with its circle centre point concentric relative to the axis of rotation of the actuator and which, in one position of the cam part and thus of the actuator, prevents the coupling for the activation of the hammer mechanism from being brought into engagement by pressing the drilling and/or chiselling bit located in the tool holder against the workpiece, i.e. pure drilling operation results in this position. On the other hand, a guide curve is formed in the actuator which, in all positions, is engaged by a forked area of a slide part. As a result of this engagement, when the guide curve is displaced as a result of twisting of the actuator, the guide curve effects a corresponding displacement of the slide part. This engages with an axially displaceable toothed wheel arranged on the spindle of the rotary hammer and shifts it so that, in the aforementioned position of the cam part in which the coupling for the drive of the hammer mechanism cannot be brought into engagement, it meshes with a toothed wheel on a driven intermediate shaft, which results in the position for pure drilling operation. This meshing engagement also exists in the position for rotary hammering operation in which the coupling can be brought into engagement due to a correspondingly twisted position of the cam part, whereas for pure chiselling operation the slide part moves the toothed wheel mounted on the spindle out of engagement with the toothed wheel of the driven intermediate shaft, while the position of the cam part permits the engagement of the coupling and thus the activation of the hammer mechanism.

This known rotary hammer thus permits switching between pure drilling operation, rotary hammering operation and pure hammering operation by means of a single actuator to be operated by the user, but has relatively large dimensions because of the shape of the guide curve. In addition the engagement between the guide curve and the forked section of the slide part may cause some difficulty in movability or even a blockage, so that problems result when switching.

SUMMARY OF THE INVENTION

The object of the invention is to develop a rotary hammer and in particular its switching device in such a way that it has a compact structure and can be operated without being prone to disturbance.

To achieve this object, a rotary hammer of the type mentioned at the beginning is designed according to the invention in such a way that the actuator extends through an opening or recess in the slide part and has a calm section which, in one position, keeps the slide part in the second position, while, in the other positions of the actuator, the slide part is in the first position, and the cam part is situated at the section of the actuator projecting inwards over the slide part. The cam part preferably consists of an eccentric pin provided on the actuator eccentrically relative to its axis of rotation.

With the rotary hammer according to the invention, the slide part thus has an opening or recess through which the actuator extends and, with a cam section provided at it, keeps the slide part in the second position, i.e. in the position in which no rotary driving of the tool holder takes place. In all other positions of the actuator, the slide part is shifted into the first position, for instance as a result of the fact that the slide part is spring-loaded in the direction of its first position, so that it automatically reaches this first position if the cam section ceases to engage with the slide part. The shifting of the slide part relative to the axial shifting of the toothed wheel thus takes place in a manner which is very simple and not prone to disturbance, for which essentially only a cam section needs to be formed in the section of the actuator extending through the opening or recess in the slide part, with the result that a compact structure is also obtained.

If the slide part is spring-loaded in the direction of its first position, a spring-housing projection for the end region of a helical spring can be provided at the front end of the slide part, while the other end of the helical spring rests against a wall of the rotary hammer housing.

As already mentioned, the cam part may consist of an eccentric pin provided eccentrically relative to the axis of rotation of the actuator, wherein the eccentric pin is inserted into the outer end of the actuator, but may of course also be designed as part of the actuator. In the position for pure drilling operation, the eccentric pin can rest against the end-face of a bush element forming one coupling half of the coupling and keep this out of coupling engagement with the other half of the coupling, with the result that the hammer mechanism is not driven by the rotatingly driven intermediate shaft. In the positions of the actuator for rotary hammering operation and pure hammering operation, the eccentric pin is out of engagement with the bush element of the coupling, with the result that the coupling is in engagement and a drive of the hammer mechanism takes place.

The bush element can be arranged with inner splines in a non-rotatable but axially displaceable manner on a drive element for the hammer mechanism, and the other half of the coupling can be formed by a suitably splined section of the intermediate shaft.

BRIEF DESCRIPTION OF THE DRAWINGS

The invention is explained in more detail below with reference to the figures showing an embodiment.

DETAILED DESCRIPTION OF THE PREFERRED EMBODIMENT

Figure 1:
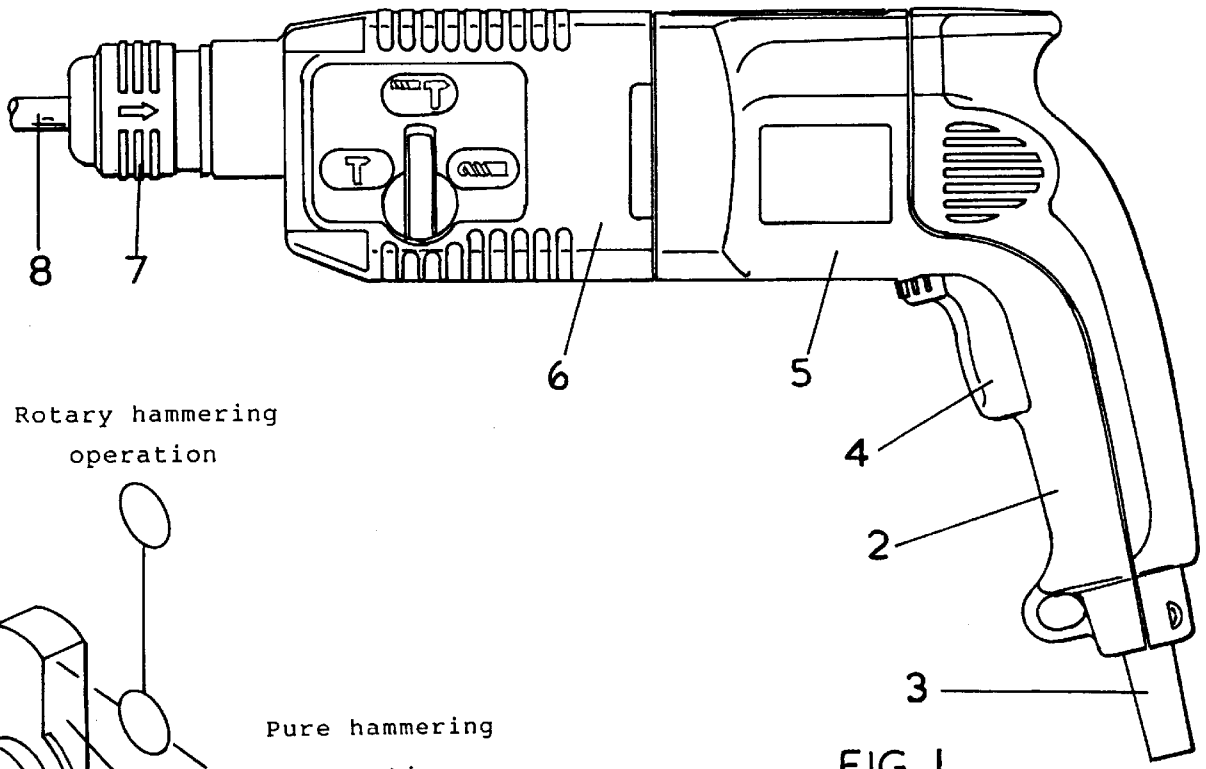
FIG. 1 shows a rotary hammer in perspective schematic representation.

The rotary hammer 1 represented in FIG. 1 has a motor housing 5 to which is attached, towards the front, a gear housing 6 at the front end of which is provided a tool holder 7 of customary design, for instance a tool holder such as is used for a so-called SDS plus bit 8. At its rear end the motor housing 5 becomes a handle 2, out from which is led the power supply cable 3 for connecting the drive motor consisting of an electric motor to a customary power source. Motor housing 5 and handle 2 can be formed by two plastic half-shells, while the gear housing 6 consists, in the represented case, of a "pot". From the handle there projects a trigger element 4 which can, in the usual manner, be displaced against spring pressure into the handle 2 to operate the on/off switch, which is not represented, in order to activate the drive motor.

Figure 2:
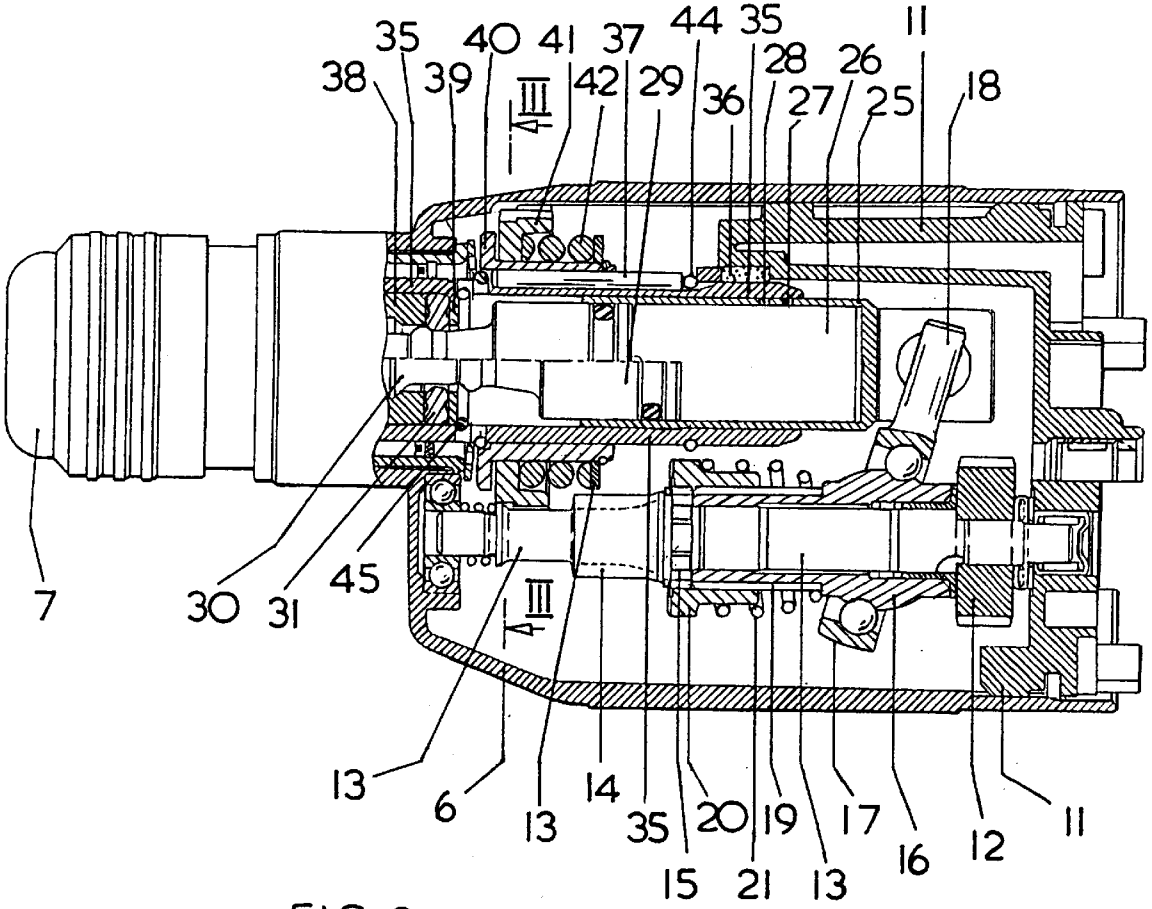
FIG. 2 shows the tool holder of the rotary hammer from FIG. 1 in plan view and the gear housing in section, the ram of the hammer mechanism being shown in the upper half in the idling position and in the lower half in the operating position of the hammer mechanism.

As can be seen from FIG. 2 in particular, there is provided in the gear housing 6 an intermediate shaft 13 which is rotatably housed with its rear end via a bearing in a metal housing 11 and with its front end via a bearing in the gear housing 6. Secured non-rotatably on the rear end section of the intermediate shaft 13 is a toothed wheel 12 which meshes in customary manner with a pinion formed on the armature shaft of the drive motor which is not represented, so that the drive motor drives the toothed wheel 12 and thus the intermediate shaft 13 in rotating manner. Arranged close to the front end of the intermediate shaft 13 on the latter is a toothed wheel section 14, the function of which will be explained later. Located adjacent to the toothed wheel section 14 and behind the latter is a splined section 15. Mounted rotatably on the intermediate shaft between the toothed wheel 12 and the splined section 15 is a support bush 16 on which a wobble ring 17 carrying a wobble pin 18 is rotatably housed over ball bearings. The front section of the support bush 16 carries on its outside splines 19 which correspond to those of the splined section 15, adjacent to which the splines 19 are located. Seated on the splines 19 is a bush element 20 which has inner splines corresponding to the splines 19 and which is thus mounted non-rotatably, but axially displaceable on the support bush 16. A compression spring 21 acts on the bush element 20, which spring normally presses the bush element 20 into the position shown in FIG. 2, in which the inner splines of the bush element 20 are in positive engagement both with the splines 19 of the support bush 16 and with the splined section 15 of the intermediate shaft 13. In this way, the support bush 16 is kept in drive connection with the intermediate shaft 13.

The wobble finger 18 is connected in conventional manner to the rear end of a hollow piston 25 of the pneumatic hammer mechanism, the structure of which corresponds to that of EP Patent No. 0 331 619. The hollow piston 25, which, in order to produce the reciprocating movement of the ram 29 located in it, has the necessary vent openings 27, 28 which connect its inner space 26 located between the bottom wall of the hollow piston 25 and the rear end of the ram 29 to the ambient air in certain positions. The hollow piston 25 extends parallel to the intermediate shaft 13 and coaxially relative to the central axis of the tool holder 7. It is guided in the inside of the spindle 35 which, at its front end, is connected non-rotatably to the tubular body of the tool holder 7. Through the reciprocating movements of the hollow piston 25 in hammering and rotary hammering operation (lower half of the representation of the hollow piston 25), the ram 29 transmits impacts onto the rear end of an anvil 30 which transmits the impacts onto the rear end of the drilling or chiselling bit 8 inserted into the tool holder 7. During idling (upper half of the representation of the hollow piston 25) the anvil 30 is moved forward into a front endposition because of the absence of resistance to shifting of the drilling or hammer bit 8. As a result the front end-section of the ram 29 which has reduced diameters enters, as represented, the area of a so-called catching device. This contains a rubber ring 31 which sits between a sleeve part 38 and a supporting disk 39 and which holds the ram 29 with its radially inward-projecting part in the forward-shifted, shown position, so that the ram 29 is held in its forward, caught position although, in the manner known for such hammer mechanisms, a reciprocating movement of the hollow piston 25 continues to take place during idling.

The spindle 35 is held rotatable by means of front bearings and a partly indicated rear bearing 36 and is supported in axial direction by circlips 44 and 45. Seated on it is a support element 40 which carries, between a front flange and a rear circular disk 43 arranged against it, a toothed wheel 41 which is pressed forwards by a helical spring 42 supported against the circular disk 43. The toothed wheel 41 is arranged on the support element 40 and engages with a cam, not shown, provided at its end-face with corresponding cams of the support element 40. The toothed wheel 41 meshes in a position to be described for pure drilling operation and, for rotary hammering operation, with the toothed wheel section 14 on the intermediate shaft 13. In the position shown in FIG. 2 for pure hammering operation, on the other hand, it does not engage with this toothed wheel section 14 and is shifted forward in such a way that its teeth are pressed into engagement with a locking metal plate 46 (FIG. 3) which is secured to the gear housing 6 by means of two bolts 47 and whose tooth section, through the engagement with the teeth of the toothed wheel 41, locks this against twisting. The toothed wheel 41 can thus not be rotated in pure hammering operation. It should be mentioned that the spring 42 serves to effect the engagement of the cams of the toothed wheel 41 with the cams of the support element 40 to form an overload coupling between these.

As represented, there is provided in the spindle 35 an axially extending keyway into which is inserted a cylindrical pin 37 which engages with an inner keyway of the support element 40. In this way, the support element 40 is held non-rotatably on the spindle 35.

The switching of the represented rotary hammer between the different operating states, namely pure drilling operation, rotary hammering operation and pure hammering operation, takes place through corresponding shifting of the support element 40 and thus of the toothed wheel 41 and of the bush element 20. A switching device which is essentially represented in FIGS. 4 to 8 is used for this purpose.

Figure 8:
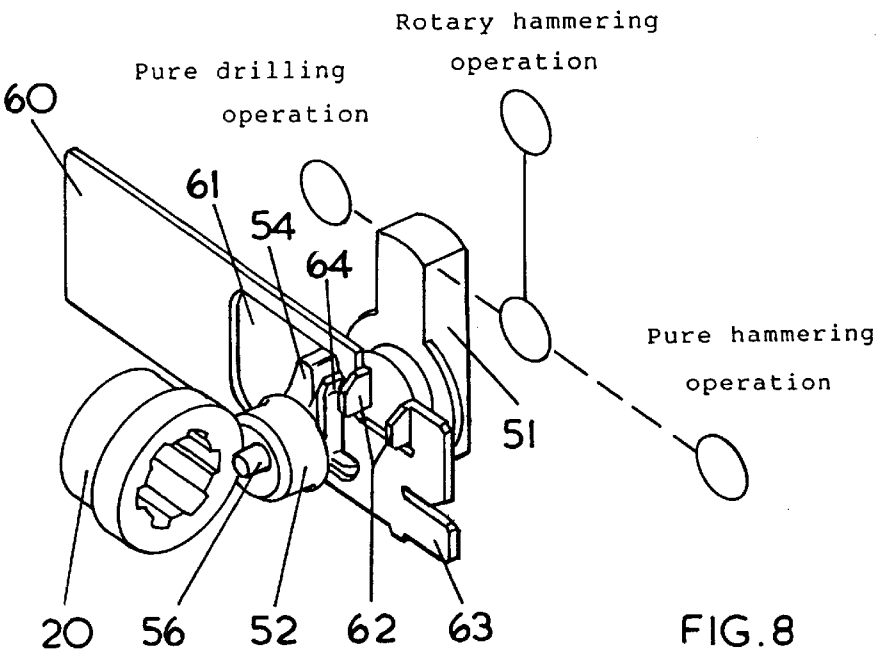
FIG. 8 shows in a perspective schematic representation the interaction of parts of the switching device.
Figure 5:
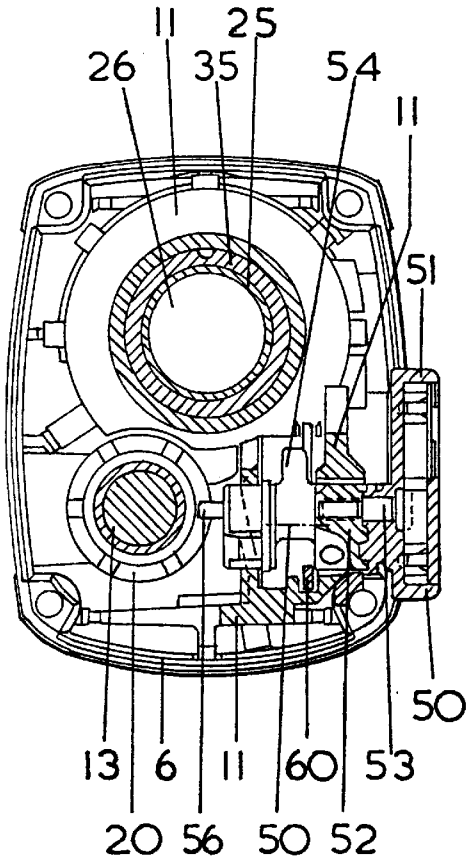
FIG. 5 shows a section along the line V—V from FIG. 4.

The switching device has an actuator 50 (FIG. 5) which has a rotation body 52 and a gripping part 51. The gripping part 51 to be operated by the user is connected in untwistable manner via a bolt 53 and corresponding cam projections and recesses to the rotation body 52, so that the latter is rotated about the central axis 59 upon operation of the gripping part 51. Secured to the inner end of the rotation body 52 is an eccentric pin 56 extending parallel to the central axis 59 but arranged laterally offset relative to the latter (FIGS. 5 and 8). This eccentric pin extends into the area of the front, annular end-face of the bush element 20 which, in the position according to FIG. 2, couples the intermediate shaft 13 to the support bush 16.

Figure 3:
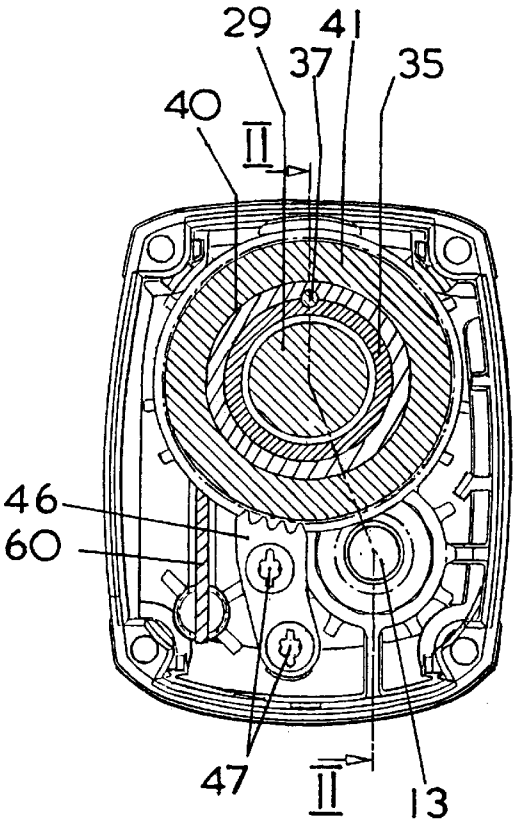
FIG. 3 shows a section along the line III—III from FIG. 2.

A slide part 60 which, guided between housing projections, is movable between a rear or first position (FIGS. 4 and 6) and a front or second position (FIG. 7) and forms part of the switching device. The slide part 60 has at the front end a spring-housing projection 63 onto which is fitted the rear section of a helical spring 65 which thereby is supported on the one hand at the slide part 60 and on the other at a wall of the gear housing 6 and thus spring-loads the slide part 60 in the direction of the rear or first position. A cut-out section 62 in the slide part 60 forms a forked opening whose limiting walls grip round the toothed wheel 41. A shifting of the slide part 60 between the rear or first position and the forward or second position thereby causes displacement of the toothed wheel 41 between the rear position (FIGS. 4 and 6) in which the toothed wheel 41 meshes with the toothed wheel section 14 of the intermediate shaft 13, and a position (FIGS. 2 and 7) in which the toothed wheel 41 does not engage with the toothed wheel section 14 and is shifted into the position for the engagement with the locking metal plate 46 (FIG. 3).

The slide part 60 has an opening 61 which, at the front end, has an actuation surface formed by a bent portion 64 and through which the rotation body 52 of the actuator extends. In the area of this opening 61, which lies between the gripping part 51 and the eccentric pin 56 of the actuator 50, the rotation body 52 forms a cam section 54 which is roughly in the shape of a finger, starting from the central axis 59 and extending radially in one direction, which has a flat surface 55 on one side. In the position of the actuator 50 in which the flat surface 55 of the cam section 54 extends parallel to the bent portion 64 of the slide part (FIG. 4) and also in the position twisted counter-clockwise by 90° compared with this (FIG. 6), the slide part 60 is located in its rear or first position and is pressed by the force of the spring 65 against a stop formed by the housing, without the bent portion 64 or the actuation surface formed by it being in contact with the cam section 54. Nor does the transfer between these two positions of the actuator 50 lead to such a contact, as the distance of the arcuate surface from the cam surface of the cam section 54 which connects the surface 55 with the flat surface 55' offset by 90° relative to it (FIG. 4), has a radius which is smaller than the distance between the central axis 59 and the actuation surface formed by the bent portion 64 when the slide part 60 is in the rear or first position.

Figure 4:
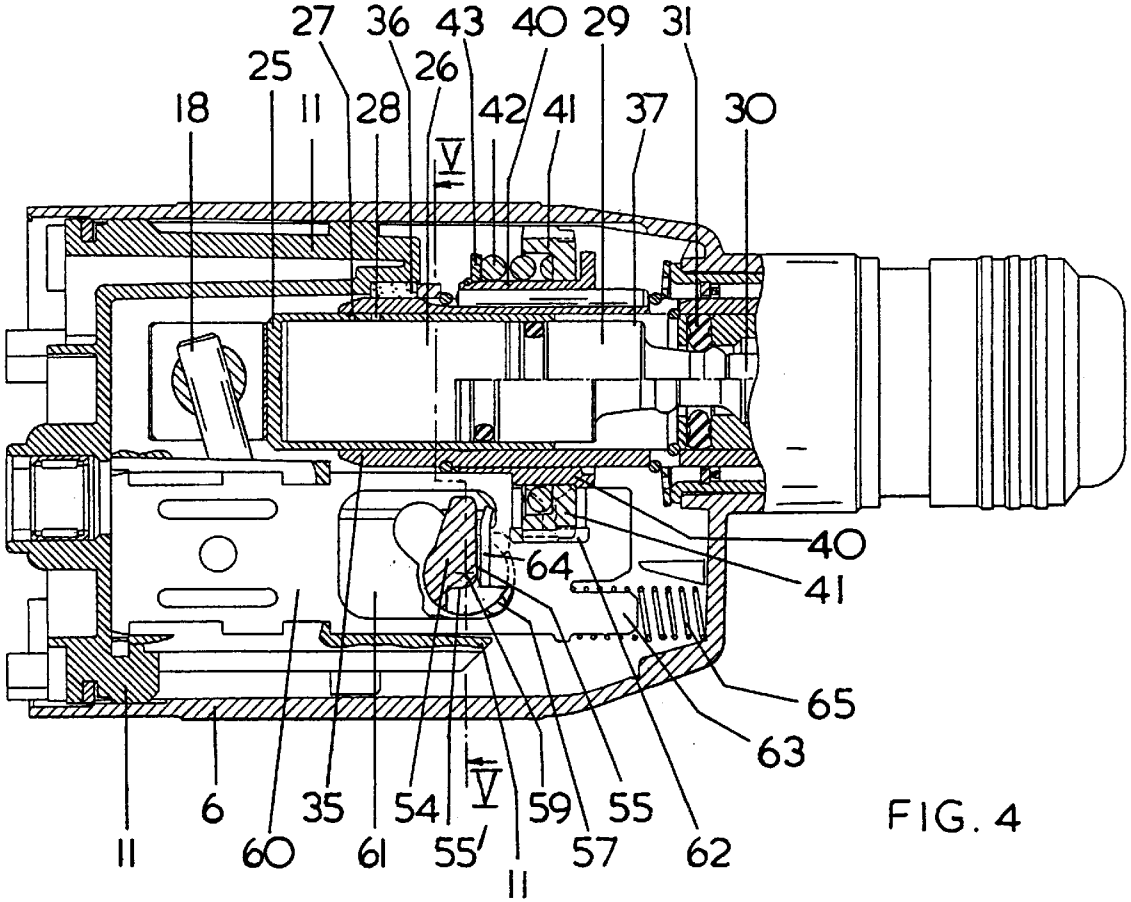
FIG. 4 shows in a representation corresponding to FIG. 2 the gear housing and the tool holder of the rotary hammer from FIG. 1 in section, parts of the switching device being recognisable.

If the actuator 50 is rotated clockwise out of the position according to FIG. 4, the radially extending cam section 54 comes into contact with the bent portion 64 of the slide part 60 and shifts this into the front or second position (FIG. 7), this second position being reached when the radially outer end and the surface formed by this and running parallel to the surface 55', lies against the bent portion 64. As already mentioned, in this position the toothed wheel 41 finds itself out of engagement with the toothed section 14 of the intermediate shaft 13 and is locked against rotation by the locking metal plate 46.

As is to be deduced from FIG. 8 in particular, the eccentric pin 56 of the actuator 50 is located, in the rotary hammering position represented there, at a small distance from the front end-face of the sleeve element 20. The sleeve element 20 is located in the position according to FIG. 2, in which it couples the intermediate shaft 13 to the support bush 16, with the result that the hammer mechanism is activated. In this position, the slide part is in its first or rear position according to FIG. 4. The toothed wheel 41 is thus coupled with the toothed wheel section 14 of the intermediate shaft 13, and the tool holder is rotatingly driven. This is thus the position for rotary hammering operation.

Figure 6:
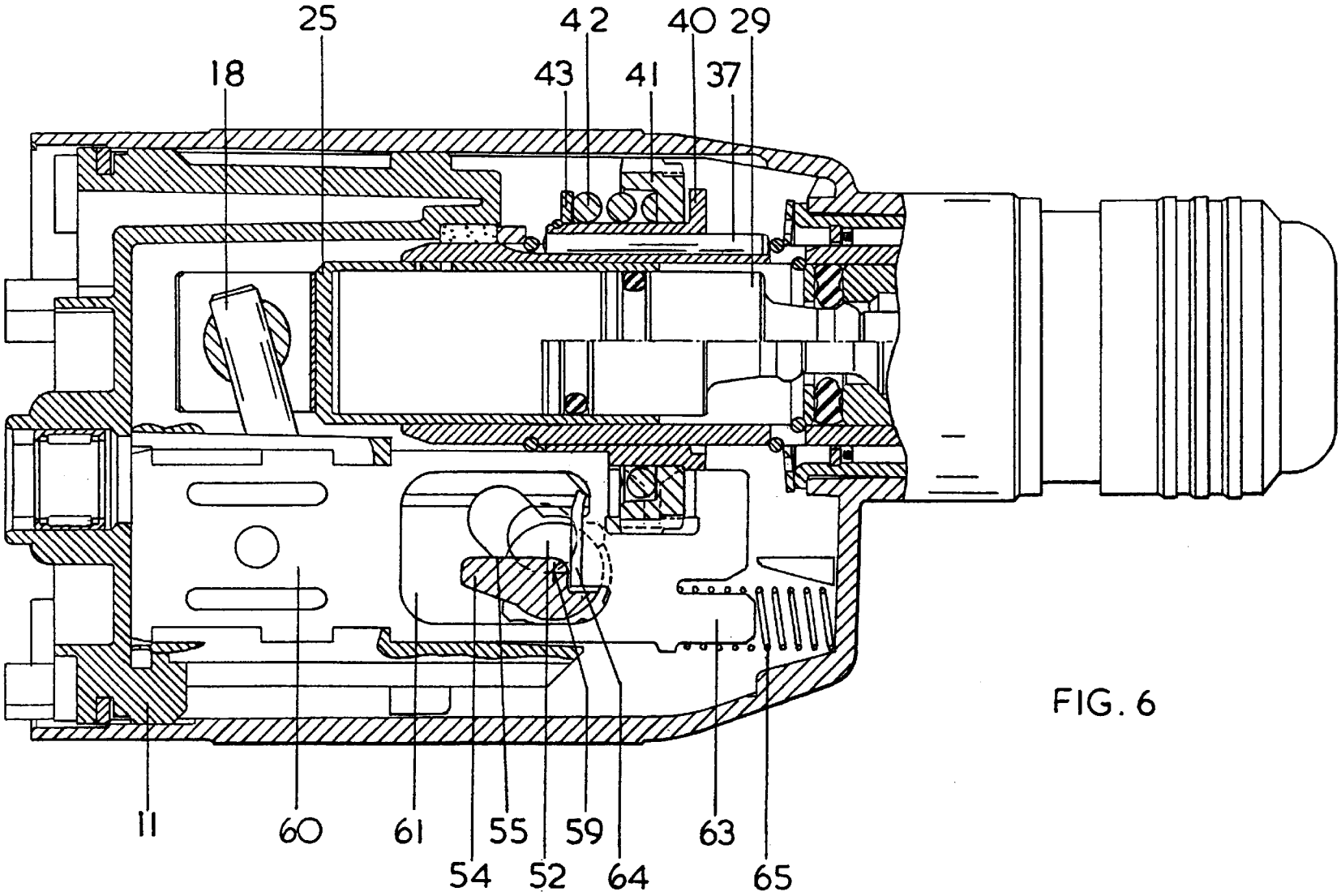
FIG. 6 shows in a representation corresponding to FIG. 5 the rotary hammer with the switching device in the position for pure drilling operation.

If the gripping part 51 is twisted clockwise by 90 out of the position according to FIG. 8, seen from the user, the cam section 54 reaches the position according to FIG. 6, i.e. there is no shifting of the slide part 60. However, the eccentric pin 56 comes to rest against the end-face of the bush element 20 and shifts this against the pressure of the spring 21 (FIG. 2) to the rear and out of engagement with the splined section 15 of the intermediate shaft 13. Since, as a result, the support sleeve 16 is no longer in driving connection with the intermediate shaft 13, the hammer mechanism is also no longer driven, but there is merely a rotary driving of the tool holder 7 via the toothed wheel 41. The actuator 50 is thus located in the position for pure drilling operation.

If, on the other hand, the gripping part 51 of the actuator 50, seen from the user, is rotated counter-clockwise by 90° out of the position according to FIG. 8, the cam section 54 brings about the shifting of the slide part 60 into its front or second position (FIG. 7) and thus the shifting of the toothed wheel 41 out of engagement with the toothed wheel section 14 of the intermediate shaft 13 and into engagement with the locking metal plate 46. The rotary drive for the tool holder 7 is therefore interrupted. Upon this shifting movement of the gripping part 51, the eccentric pin 56 moves along an arc of 90°. However, it still remains at a distance from the front end-face of the bush element 20, with the result that the latter is not moved out of its coupling position according to FIG. 2 and as a result the hammer mechanism is driven by the intermediate shaft 13.

Figure 7:
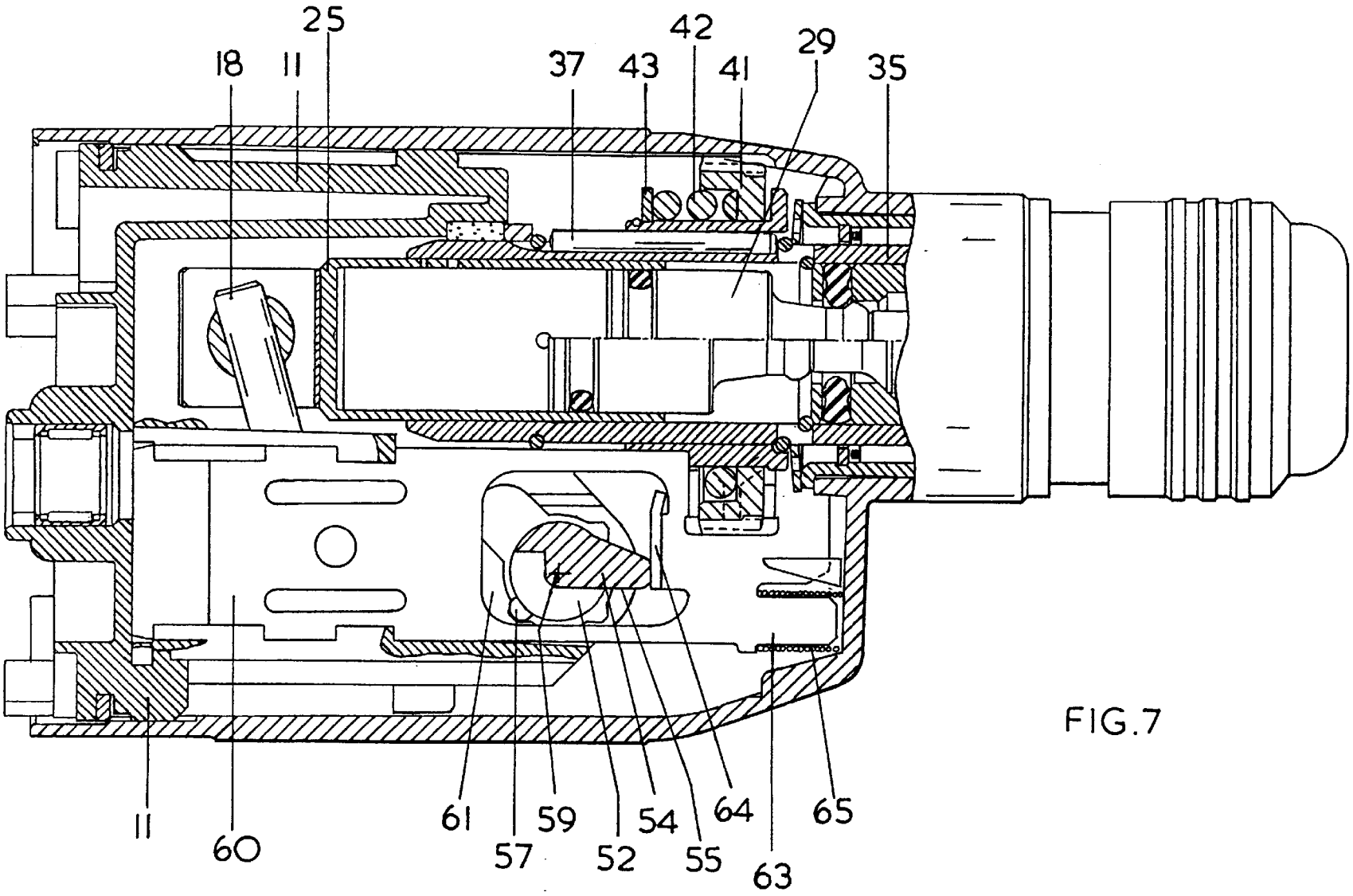
FIG. 7 shows in a representation corresponding to FIG. 6 the rotary hammer with the switching device in the position for pure hammering operation.

If the gripping part 51 of the actuator 50 is turned back out of the position according to FIG. 7, the force of the spring 65 brings about a shifting of the slide part 60 in the direction of its rear or first position, and the slide part 60 shifts the toothed wheel 41 in the direction of engagement with the toothed wheel section 14 of the intermediate shaft 13. However, there may be an engagement-preventing contact of tooth-face surfaces of toothed wheel 41 and toothed wheel section 14. The engagement then takes place automatically as a result of the spring loading of the slide part 60 upon the first slight twisting of the intermediate shaft 13.

In order to fix the positions of the actuator 50 that are shown in FIGS. 4, 6 and 7, there is present in the rotation body 52 a radially outwardly spring-loaded stop pin 57 (FIGS. 4 and 7) which, in each of the three positions of the actuator, locks in a locking recess in the surrounding housing 11 and thus defines the respective position of the actuator 50.

We claim:

1. Rotary hammer for supporting a bit (8), and operable in a pure drilling operation, a rotary hammering operation and a pure hammering operation, including:

a tool holder (7) provided at a front end of the hammer for holding the bit (8), a rotary drive coupled to the tool holder (7) to produce a rotary movement of the tool holder (7) and thereby the bit (8), a hammer mechanism (25, 29, 30) for transmitting impact energy onto the bit (8), a coupling (15, 20) with:

a rotatingly driven intermediate shaft (13);

a switching device for switching amongst the pure drilling operation, the rotary hammering operation and the pure hammering operation;

the switching device including (1) a single actuator (50) to be operated by a user for switching between the drilling, the rotary hammering and the pure hammering operation, (2) a cam part (56) which is movable and coupled with the actuator, and (3) a slide part (60) for the shifting of a toothed wheel (41) along an axis of the wheel;

wherein in the position for pure drilling the cam part (56) keeps the coupling (15, 20) disengaged and wherein the slide part (60), in a first position thereof, keeps the toothed wheel (41) in a position for the rotary driving of the tool holder (7) and, in a second position of the slide part, keeps the toothed wheel (41) in a position in which no rotary driving of the tool holder (7) takes place, characterised in that:

the actuator (50) extends through an opening (61) in the slide part (60) and has a cam section (54) which, in one position, keeps the slide part (60) in the second position, while, in the other positions of the actuator (50), the slide part (60) is in the first position, and in that the cam part (56) is provided at a section of the actuator (50) projecting inward over the slide part (60).

2. Rotary hammer according to claim 1, characterised in that the cam part consists of an eccentric pin (56) coupled to the actuator (50) for movement eccentrically relative to an axis of rotation (59) of the actuator.

3. Rotary hammer according to claim 2, characterised in that, in the position of the actuator (50) for pure drilling operation, the eccentric pin (56) rests against the end-face of a bush element (20) forming one coupling half of the coupling and keeps the one coupling half out of coupling engagement with the remaining half of the coupling (15).

4. Rotary hammer according to claim 3, characterised in that the bush element (20) is formed with inner splines in a non-rotatble but axially displaceable manner on a drive element (16) for the hammer mechanism (25,29,30), and the another half of the coupling is formed by a correspondingly splined section 19 of the intermediate shaft (13).

5. Rotary hammer according to claim 3, characterised in the bush element (20) is urged by a spring (21) toward the coupling engagement position.

6. Rotary hammer according to claim 1, characterised in that the slide part (60) is urged by a spring (65) toward the first position of the slide part.

7. Rotary hammer according to claim 6, characterised in that the slide part (60) has at a front end thereof a spring-housing projection (63) for one region of a helical spring (65), an opposite end of the spring rests against a wall of a rotary hammer housing.

* * * * *